United States Patent [19]

Miller

[11] Patent Number: 4,593,899

[45] Date of Patent: Jun. 10, 1986

[54] EXERCISE JUMPING ROPE

[76] Inventor: Robert A. Miller, P.O. Box 4500, Laguna Beach, Calif. 92652

[21] Appl. No.: 651,539

[22] Filed: Sep. 17, 1984

Related U.S. Application Data

[63] Continuation-in-part of Ser. No. 148,244, May 9, 1980, Pat. No. 4,489,934.

[51] Int. Cl.[4] ..... A63B 5/20

[52] U.S. Cl. ..... 272/75; 16/110 R

[58] Field of Search ..... 272/74, 75, 68, 67, 272/124, 128, 135, 140, 143, DIG. 5; 446/215, 30; 16/110 R, 114 R, 114 B

[56] References Cited

U.S. PATENT DOCUMENTS

| | | | |
|---|---|---|---|
| 932,331 | 8/1909 | Russell et al. | 272/75 X |
| 1,562,521 | 11/1925 | Schlegel | 16/110 R |
| 1,817,616 | 8/1931 | Goff | 272/75 |
| 2,944,817 | 7/1960 | Stiller | 272/75 X |
| 4,179,119 | 12/1979 | Wolf | 272/75 |
| 4,201,382 | 5/1980 | Wilson | 272/75 |
| 4,489,934 | 12/1984 | Miller | 272/75 |
| 4,505,474 | 3/1985 | Mattox | 272/75 |

FOREIGN PATENT DOCUMENTS

| | | | |
|---|---|---|---|
| 498972 | 11/1954 | Italy | 272/75 |
| 6410094 | 3/1966 | Netherlands | 272/75 |
| 601946 | 5/1948 | United Kingdom | 272/75 |

*Primary Examiner*—Robert A. Hafer
*Assistant Examiner*—Arnold W. Kramer
*Attorney, Agent, or Firm*—Michael A. Painter

[57] ABSTRACT

A jumping rope for exercising including resiliently flexible handles for adjustably altering the moment of force imposed upon the user by the swinging rope. The jump rope construction includes evenly extended handles at each end thereof. The interval between the extended handles and a ball bearing assembly within which the rope is secured comprises a resilient member which will vary the torsional force along its longitudinal axis. The rope is joined to the handle section by a ball bearing assembly which is recessed from the handle shoulder. The handle section adjacent the rope is a terminal coupling and has a tapered cross-section at the shoulder thereof to reduce the friction between the rope and the shoulder of the handle section. The opposite end of the receiving handle section is joined to a mating extension which resiliently bends along its longitudinal axis and can be easily gripped by the user. The flexiblity of the resilient member is in response to the rate of rotation of the rope and thereby changing the effective distance between the user's hand and the point at which the force of the swinging rope will be applied to the handle.

9 Claims, 3 Drawing Figures

EXERCISE JUMPING ROPE

This is a continuation-in-part of Applicant's copending application Ser. No. 148,244, filed May 9, 1980, and now U.S. Pat. No. 4,489,934.

BACKGROUND OF THE INVENTION

1. Field of the Invention

The present invention relates generally to jump ropes and more specifically to a jump rope construction which has a handle which permits a change in the force which is applied to the user's hands, arms and shoulders by the swinging rope.

2. Prior Art

The structure of exercise devices which are in the form of jump ropes has improved over the years from its beginning models, which featured a simple rope. More sophisticated structures were then provided wherein a simple handle was tied or otherwise crudely attached to each end of the rope. More recently, the structure has been improved wherein large wooden handles were staked by a metal plate, which defined a central opening through which a rope was held by a ball bearing assembly which fit within the wooden handle. One of the inherent problems in this type of design was the tendency of the rope to twist because of its connection between the rope and handle.

The simplified design was later improved to utilize a ball bearing assembly, but such assemblies were too expensive and sophisticated for the intended use. Its disassembly for repair or replacement purposes was impossible due to the particular connections used between the rope and handle. A subsequent improvement upon the devices taught in the prior art uses only a ball bearing assembly which defines as its center a rope opening through which the rope extends and is held by the stopping element. The ball bearing assembly includes the usual race and balls rotatably encased within a ball bearing housing.

One of the basic problems inherent in all of the devices taught by the prior art is the placement of the connection between the rope and the handle irrespective of whether a ball bearing assembly is used. Since the portion of the rope which extends from the handle must curve about the end of the handle in order to be placed in its proper position, any crimping or friction which is created between the rope ending and the handle will retard its proper use. In addition, the devices taught by the prior art fail to provide for means which would extend the effective distance between the portion of the handle which is held by the user and the interface between the handle and the rope. By providing for an effective extension of this distance, the force imposed by the moving rope on the hands, arms and shoulders of the user can be increased or decreased at will thereby enabling the user to adjust the ease or difficulty of the exercise.

A form of the present invention substantially resolves those problems inherent in the devices taught by the prior art by employing a handle which can be elongated or decreased in length. The change in the length of the handle will change the force imposed on the user's hands when the rope is in use. In addition, the placement of the connection between the rope and handle as well as the profile of the terminal coupling of the handle improves the ease with which the present invention can be used as well as increasing the efficiency of the total assembly. A preferred form of the present invention resolves the problems inherent in those devices taught by the prior art through the use of a resilient member which is disposed between the handle and the rope coupling and which flexes along its longitudinal axis. As the user rotates the rope at a higher rate of speed, the force which is imposed at the coupling between the rope and the handle will increase thereby creating a proportionally greater bending moment in the resilient member with a corresponding increase in the forces which are imposed upon the user's hands, arms and shoulders.

SUMMARY OF THE INVENTION

The present invention comprises an exercising jump rope construction which includes handle extensions which will enhance the forces imposed upon the user's arms, hands and shoulders through the use of a member which is resiliently deflected along its longitudinal axis in response to rope rotation. The handles for the present invention jump rope each comprise a substantially cylindrical member which will be resiliently deflected along its longitudinal axis. The variation of the moment of force effectively extends or reduces the distance between the hands of the user and the point of contact between the rope and handle. The ball bearing assembly to which the rope is coupled is recessed within the handle. The terminal coupling of the handle is tapered outwardly to avoid and/or reduce any friction between the rotating rope and the handle. The greater the rate of rotation of the rope, the greater will be the force imposed on the resilient member which will effectively increase the moment arm which transfers the force created by the rotating rope to the user's hands, arms and shoulders.

It is therefore an object of the present invention to provide an improved exercise jumping rope construction.

It is another object of the present invention to provide an exercise jumping rope construction having handles which impose variable forces in response to rope rotation.

It is still another object of the present invention to provide an exercise jumping rope construction which reduces interference with the rotation of the rope.

It is still yet another object of the present invention to provide an exercise jumping rope construction which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only and is not intended as a definition of the limits of the invention.

DESCRIPTION OF THE PRESENTLY PREFERRED EMBODIMENT

Figure 1:
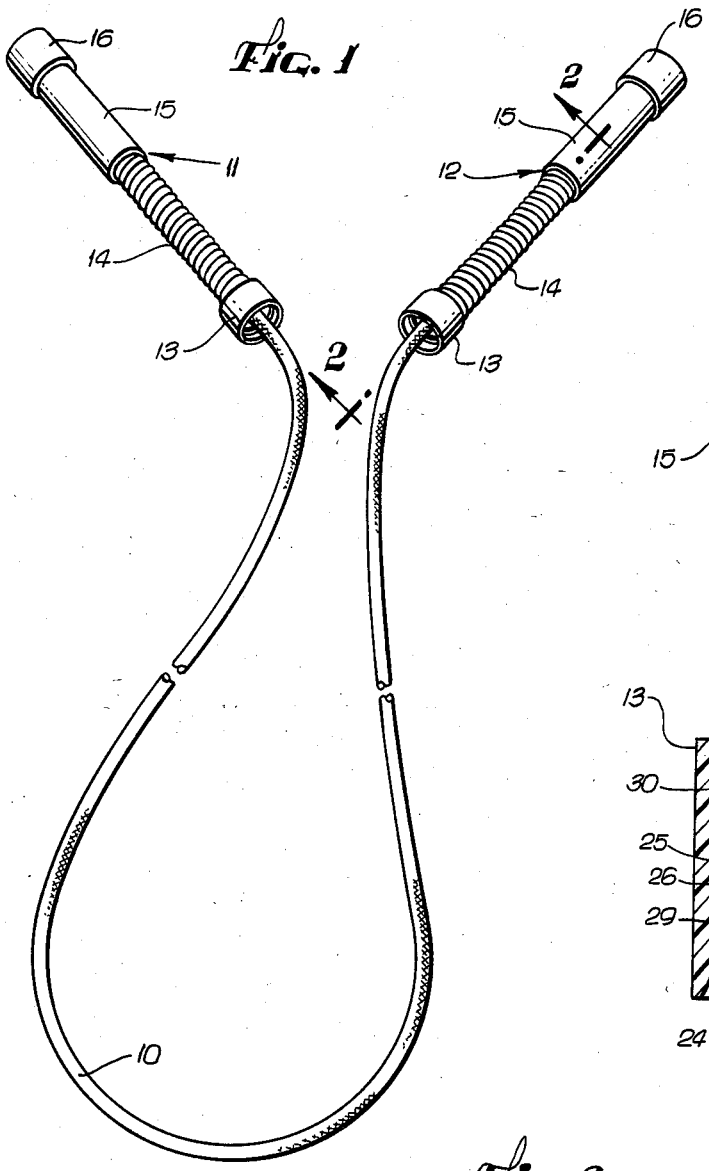
FIG. 1 is a pictorial view of an exercise jumping rope according to the present invention showing a rope extended between two handles.

An understanding of the present invention can be best gained by reference to FIG. 1 wherein a rope 10 is shown extending between handles 11 and 12. The use of the present invention is conventional in that the user holds each of the handles 11 and 12 in one hand respectively, rotating rope 10 while preferably maintaining handles 11 and 12 in an upwardly oriented or parallel spaced relationship to the ground while simultaneously locking the wrists in a fixed position during the jumping exercise. As will be described hereinbelow, each of the handles 11 and 12 employs a terminal coupling 13 which is engaged to a resilient extension member 14. An object of the present invention is to provide handles 11 and 12 which will provide variable forces upon the user's hands, arms and shoulders. Handle grips 15 are secured to extension members 14 and are closed by an appropriate cap 16 which will faciliate the user to maintain his hands in a fixed position when the rope 10 rotates.

Figure 2:
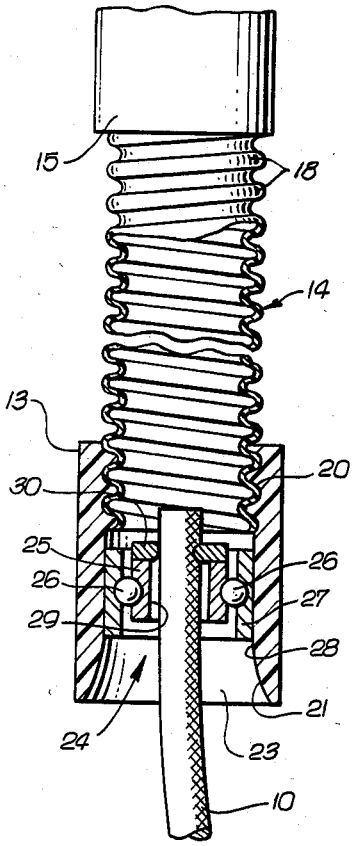
FIG. 2 is a cross-sectional view taken through line 2—2 of FIG. 1 and particularly showing the connection between the resiliently extended handle and rope through the use of a ball bearing assembly.

An understanding of the operation of the present invention can be best gained by reference to FIG. 2 wherein a cross-sectional view of the interface between the rope and handle assembly 12 is shown. As stated, handle assembly 11 (and 12) comprises terminal coupling 13 which is serially engaged to a resilient member 14, handle grip 15 and cap 16. In the preferred embodiment of the present invention, the objective of for enhanced torsional forces is accomplished through the use of resilient extension member 14. Resilient extension 14 is a substantially cylindrical body 17 which is typically fabricated with a spiral or axially aligned ribs 18 which are disposed about the circumferential surface thereof in parallel spaced relation to each other. Member 14 is constructed of a suitable lastomeric or thermoplastic substance such as polypropylene, nylon or polyethylene. The cylindrical structure of extension member 14 gives it strength along its longitudinal axis, but the longitudinal axis can be deflected in relation to any forces imposed on an end thereof. Through the use of ribbed surface 18, the force required to deflect the member 14 can be altered merely by changing the wall thickness 19. Finally, resilient extension member 14 is engaged with terminal coupling member 13 at interface 20 which comprises mated screw-threads disposed along the inner diameter of terminal coupling 13 and the outer diameter of resilient extension member 14. Although the use of a ribbed cylindrical structure for extension member 14 is preferred, it is clear that other conventional structures could be used which would provide for resilient deflection during the imposition of force at an end thereof.

Recessed within open end 23 of terminal coupling 13 is a ball bearing assembly generally designated by the reference numeral 24. Ball bearing assembly 24 typically includes an inner race element 25 and ball bearings 26 which are known in the prior art. Ball bearing housing 27 forms the outer race and defines an outer surface of generally circular cross-section which is secure to the cylindrical inner wall of terminal coupling 13. Rope 10 extends through a central opening 29 through inner race element 25. The rope is secured to ball bearing assembly 24 by conventional means such as a washer stop element 30 which is in end abuttment with inner race element 25.

Figure 3:
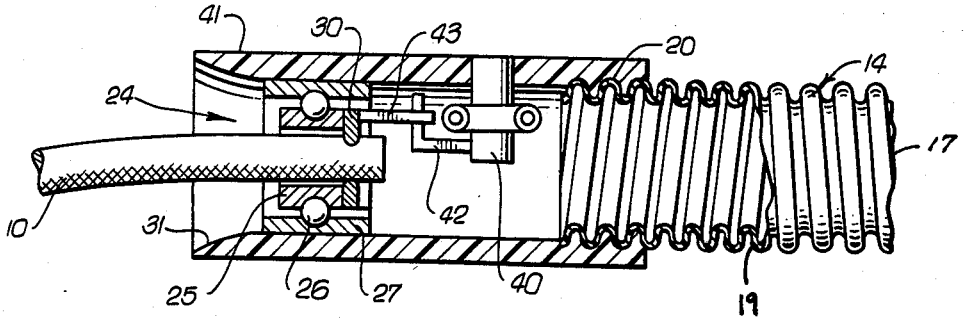
FIG. 3 is a cross-sectional view of another form of the present invention employing a counter to indicate the number of rotations of the rope.

An objective of the present invention is to reduce any frictional forces which may exist between rope 10 and terminal coupling 13 while the present invention is being used. In order to accomplish this objective, the inner wall 28 of terminal coupling 13 at the open end 23 is tapered outwardly to provide a surface 31 which is tapered outwardly to provide a constantly increasing diameter. As is shown in FIG. 3, the contact between rope 10 and surface 31 is reduced by the constantly increasing diameter of surface 31, the objective thereof being to match the curvature of surface 31 of terminal coupling 13 to the curvature of rope 10 as it exits from open end 23 of terminal coupling 13. It is also to be noted that recessing ball bearing assembly 24 within the open end 23 of terminal coupling 13 aids the rotation of rope 10 with relationship to handles 11 and 12.

In operation, as rope 10 is rotated within terminal coupling 13, the rope 10 will be disposed at a substantially right angle to the longitudinal axis of resilient extension member 14. The higher the rate of roation of rope 10, the greater will be the moment of force which is imposed upon the resilient extension member 14 at interface 20. Since resilient extension member 14 will flex along its longitudinal axis in relation to the moment of force imposed at interface 20 thereby encouragaing an oscillating movement, the user can control the force which is imposed upon his or her hands, arms and shoulders merely by changing the rate of rotation of rope 10. At a given rate of rotation of rope 10, the moment of force imposed at interface 20 will be substantially uniform throughout the entire 360° of rotation with added emphasis at each 180° of arc thereby maximizing the benefits of the present invention.

Another form of the present invention is shown in FIG. 3. FIG. 3 illustrates the addition of a rotation counter 40 to the previously described assembly. A terminal coupling 41 is utilized, the interior surface employing a surface 31 in the same manner as that described with respect to FIG. 2. Counter 40 is a conventional device which is secured within the inner opening of terminal coupling 41, the readout of counter 40 being visible through the wall of terminal coupling 41. Counter 40 employs stepping lever 42 which will increment the count each time it is engaged by rod 43 which is secured to washer stop elements 30 perpendicular to the face thereof. As can be seen in FIG. 3, each time rope 10 is rotated, inner race element 25 of ball bearing assembly 24 will rotate accordingly. Since washer stop element 30 is secured to inner race element 25, rod 43 will rotate in a like manner. As a result of rod 43 contacting stepping lever 42 once per rotation, counter 40 will increment the count properly. As an alternative, counter 40 can be implemented through the use of conventional magnetic or light sensitive means which will provide a translation of rope rotation data such as rate, number of rotations and time.

The present invention provides an improved exercise jumping rope construction which facilitates the rotation of rope 10. One of the most essential features of the present invention is provided by the use of resilient extension members 14. Resilient member 14 will flex along its longitudinal axis in relation to the force imposed by the rotation of rope 10 thereby changing the force imposed on the user. When the rope 10 is rotated, the force imposed on the user's hands, arms and shoulders will be varied in relation to the rate of rotation of rope 10. This is the same result as would occur with a rigid extension member of variable length. As the imposed force is increased, the value of the exercise is increased accordingly. It is therefore clear that the present invention provides an improved construction for an exercise jumping rope in a manner which is not disclosed by the prior art.

I claim:

1. An exercise jumping rope construction consisting of a rope coupled at each end thereof to a respective handle assembly, each handle assembly comprising:

(a) a terminal coupling comprising an enclosed hollow member having a first and second end, the inner surface of the first end of said terminal coupling being tapered outwardly to form a constantly increasing diameter at the first end thereof;

(b) a cylindrical gripping member;

(c) resilient extension means for imposing force upon the user in relation to the rate of rotation of the rope, said resilient extension means comprising a substantially cylindrical resilient member adapted to resiliently flex along its longitudinal axis upon the imposition of force by the rope at the terminal coupling, said resilient member having a first and second end, the first end thereof being coupled to said cylindrical gripping member in axial abuttment therewith, the second end being axially joined at the second end of said terminal coupling; and (d) a ball bearing assembly secured within the hollow interior of the terminal coupling substantially adjacent the first end of said terminal coupling, the ball bearing assembly including ball bearings, a race and a ball bearing housing secured to the interior surface of said terminal coupling, said ball bearing assembly having an inner race defining an opening at its center for attachment of the rope therethrough.

2. An exercise jumping rope construction as defined in claim 1 wherein the outer surface of said cylindrical resilient member is formed into a plurality of circular ribs disposed in parallel spaced relation along the longitudinal axis of said member.

3. An exercise jumping rope construction as defined in claim 2, wherein said cylindrical member is constructed of suitable thermoplastic material.

4. An exercise jumping rope construction as defined in claim 1 including means for translating rope rotation indicia, said means being mounted within said enclosed hollow member of one of said handle assemblies.

5. An exercise jumping rope construction as defined in claim 4 wherein said means for translating rope rotation indicia comprises a revolution counter coupled within the hollow interior of said terminal coupling, said revolution counter including a stepping lever and a rod secured to said inner race of said ball bearing assembly parallel to the central axis of the terminal coupling and adapted to engage said stepping lever once per revolution of said inner race.

6. An exercise jumping rope construction comprising:

(a) a pair of handle assemblies each comprising a cylindrical hollow member having a central axis therethrough, said handle assemblies having first and second ends, the rope extending from said first end, the inner surface of the first end of said handle assembly being tapered outwardly to form constantly increasing diameter at said first end;

(b) a ball bearing assembly secured within the hollow interior of said handle assembly substantially adjacent the first end of said handle assembly, said ball bearing assembly including ball bearings, a race and a ball bearing housing secured to the inner surface of said handle assembly, said ball bearing assembly having an inner race defining an opening at the center thereof along said central axis for attachment to the rope;

(c) a cylindrical, resilient member coupled at one and end to the second end of said handle assembly and adapted to flex along its longitudinal axis in relation to the rate of rotation of the rope, the outer surface of said cylindrical member being formed into a plurality of circular ribs disposed in parallel spaced relation along the longitudinal axis of said member; and (d) a gripping member attached to the other end of said cylindrical resilient member.

7. An exercise jumping rope construction as defined in claim 6 wherein said cylindrical member is constructed of a suitable thermoplastic material.

8. An exercise jumping rope construction as defined in claim 6 including means for translating rope rotation indicia, said means being mounted within said enclosed hollow member of one of said handle assemblies.

9. An exercise jumping rope construction as defined in claim 8 wherein said means for translating comprises a revolution counter coupled to said handle assembly within the hollow interior thereof, said revolution counter including a stepping lever and a rod secured to the inner race of said ball bearing assembly parallel to the central axis of said handle assembly and adapted to engage the stepping lever of said revolution counter once per revolution of said inner race.

* * * * *